US010783760B2

(12) United States Patent
Blech et al.

(10) Patent No.: US 10,783,760 B2
(45) Date of Patent: Sep. 22, 2020

(54) SURVEILLANCE APPARATUS HAVING AN OPTICAL CAMERA AND A RADAR SENSOR

(71) Applicant: Sony Corporation, Tokyo (JP)

(72) Inventors: Marcel Blech, Harrenberg (DE); Ralf Böhnke, Esslingen (DE); Furkan Dayi, Stuttgart (DE)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/199,604

(22) Filed: Nov. 26, 2018

(65) Prior Publication Data

US 2019/0096205 A1 Mar. 28, 2019

Related U.S. Application Data

(63) Continuation of application No. 14/889,081, filed as application No. PCT/EP2014/058755 on Apr. 29, 2014, now Pat. No. 10,157,524.

(30) Foreign Application Priority Data

May 23, 2013 (EP) ..... 13169006

(51) Int. Cl.
*G08B 13/196* (2006.01)
*G08B 13/187* (2006.01)

(52) U.S. Cl.
CPC ..... *G08B 13/1963* (2013.01); *G08B 13/187* (2013.01); *G08B 13/19619* (2013.01); *G08B 13/19695* (2013.01); *G08B 13/19689* (2013.01)

(58) Field of Classification Search
None
See application file for complete search history.

(56) References Cited

U.S. PATENT DOCUMENTS 6,484,619 B1 11/2002 Thomas et al.
2006/0033674 A1* 2/2006 Essig, Jr. ..... B01D 61/06 343/912
2006/0139162 A1 6/2006 Flynn
2006/0238617 A1* 10/2006 Tamir ..... G08B 13/19606 348/143
2006/0244826 A1 11/2006 Chew
(Continued)

FOREIGN PATENT DOCUMENTS

EP 2 284 568 A2 2/2011
WO 2006/074161 A2 7/2006
WO 2010/042483 A1 4/2010

OTHER PUBLICATIONS

European Communication Pursuant to Article 94(3) EPC dated Sep. 11, 2018 in European Application No. 14722155.0-1206.
(Continued)

*Primary Examiner* — Christopher Braniff
(74) *Attorney, Agent, or Firm* — Xsensus LLP

(57) ABSTRACT

A surveillance apparatus, a corresponding method, surveillance radar apparatus, computer program, and non-transitory computer-readable recordable recording medium, the surveillance apparatus including an optical camera that captures images based on received light, the optical camera having a first field of view, a radar sensor that emits and receives electromagnetic radiation, the radar sensor having a second field of view, and wherein the first field of view is variable with respect to the second field of view.

19 Claims, 8 Drawing Sheets

(56) References Cited

U.S. PATENT DOCUMENTS

| | | | | |
|---|---|---|---|---|
| 2009/0167862 | A1* | 7/2009 | Jentoft | G08B 13/19641 348/143 |
| 2010/0182434 | A1* | 7/2010 | Koch | G01S 7/4802 348/164 |
| 2011/0037640 | A1 | 2/2011 | Schmidlin | |
| 2011/0163904 | A1 | 7/2011 | Alland et al. | |
| 2012/0080944 | A1* | 4/2012 | Recker | H02J 9/02 307/25 |
| 2012/0092499 | A1 | 4/2012 | Klar et al. | |
| 2013/0093615 | A1 | 4/2013 | Jeon | |
| 2013/0093744 | A1* | 4/2013 | Van Lier | G09G 3/3466 345/212 |
| 2014/0204215 | A1* | 7/2014 | Kriel | H04N 7/181 348/159 |
| 2014/0368373 | A1* | 12/2014 | Crain | G01S 5/02 342/5 |

OTHER PUBLICATIONS

"Gyrocam Systems" Lockheed Martin, Feb. 8, 2013 http://www.lockheedmartin.com/us/products/gyrocam.html, (total 2 pages).

"MicroCoMPASS Micro Compact Multi-purpose Advanced Stabilized System—Airborne" Elbit Systems Electro-Optics—ELOP, 2009, www.elbitsystems.com/elop, (total 2 pages).

"IllumiNITE Evolutionary Visual Extension of the Eye" Ferranti Technologies, www.ferranti-technoloqies.co.uk, (total 2 pages).

Katsutoshi Ochiai, et al. "Development of the Laser Radar Surveillance System Technology at Long-distances with High-resolution Under Inclement Weather" Mitsubishi Heavy Industries, Ltd. Technical Review, vol. 42, No. 5, Dec. 2005, pp. 1-4.

International Search Report and Written Opinion dated Oct. 8, 2014 for PCT/EP2014/058755 filed on Apr. 29, 2014.

* cited by examiner

SURVEILLANCE APPARATUS HAVING AN OPTICAL CAMERA AND A RADAR SENSOR

CROSS-REFERENCE TO RELATED APPLICATION

The present application is a continuation of U.S. application Ser. No. 14/889,081, filed Nov. 4, 2015 which is a National Stage Application based on PCT/EP2014/058755, filed Apr. 29, 2014, and claims priority to European Patent Application 13169006.7, filed in the European Patent Office on May 23, 2013, the entire contents of each of which being incorporated herein by reference.

BACKGROUND

Field of the Disclosure

The present disclosure relates to the field of surveillance cameras for safety and security applications. A surveillance apparatus, having an optical camera and an additional radar sensor, and a corresponding surveillance method are disclosed. Application scenarios include burglar, theft or intruder alarm as well as monitoring public and private areas.

Description of Related Art

Optical surveillance cameras are used in many public places such as train stations, stadiums, supermarkets and airports to prevent crimes or to identify criminals after they committed a crime. Optical surveillance cameras are widely used in retail stores for video surveillance. Other important applications are safety-related applications including the monitoring of hallways, doors, entrance areas and exits for example emergency exits.

While optical surveillance cameras show very good performance under regular operating conditions, these systems are prone to visual impairments. In particular, the images of optical surveillance cameras are impaired by smoke, dust, fog, fire and the like. Furthermore, a sufficient amount of ambient light or an additional artificial light source is required, for example at night.

An optical surveillance camera is also vulnerable to attacks of the optical system, for example paint from a spray attack, stickers glued to the optical system, cardboard or paper obstructing the field of view, or simply a photograph that pretends that the expected scene is monitored. Furthermore, the optical system can be attacked by laser pointers, by blinding the camera or by mechanical repositioning of the optical system.

In addition to imaging a scenery, it can be advantageous to obtain information about the distance to an object or position of an object or a person in the monitored scenery. A three-dimensional image of a scenery can be obtained, for example, with a stereoscopic camera system. However, this requires proper calibration of the optical surveillance cameras which is very complex, time consuming, and expensive. Furthermore a stereoscopic camera system typically is significantly larger and more expensive compared to a monocular, single camera setup.

In a completely different technological field, automotive driver assistance systems, US 2011/0163904 A1 discloses an integrated radar-camera sensor for enhanced vehicle safety. The radar sensor and the camera are rigidly fixed with respect to each other and have a substantially identical, limited field of view.

The "background" description provided herein is for the purpose of generally presenting the context of the disclosure. Work of the presently named inventor(s), to the extent it is described in this background section, as well as aspects of the description which may not otherwise qualify as prior art at the time of filing, are neither expressly or impliedly admitted as prior art against the present disclosure.

SUMMARY

It is an object of the present disclosure to provide a surveillance apparatus and a corresponding surveillance method which overcome the above-mentioned drawbacks. It is a further object to provide a corresponding computer program and a non-transitory computer-readable recording medium for implementing said method. In particular, it is an object to expand the surveillance capabilities to measurement scenarios where a purely optical camera fails and to efficiently and flexibly monitor a desired field of view.

According to an aspect of the present disclosure there is provided a surveillance apparatus comprising

- an optical camera that captures images based on received light, said optical camera having a first field of view,
- a radar sensor that emits and receives electromagnetic radiation, said radar sensor having a second field of view; and wherein said first field of view is variable with respect to said second field of view.

According to a further aspect of the present disclosure there is provided a corresponding surveillance method comprising the steps of

- capturing images based on light received with an optical camera, said optical camera having a first field of view,
- emitting and receiving electromagnetic radiation with a radar sensor, said radar sensor having a second field of view, and wherein said first field of view is variable with respect to said second field of view.

According to a further aspect of the present disclosure there is provided a surveillance apparatus comprising

- an optical camera that captures images based on received light, said optical camera having a first field of view,
- a radar sensor that emits and receives electromagnetic radiation, said radar sensor having a second field of view, and wherein said second field differs from said first field of view.

According to a further aspect of the present disclosure there is provided a surveillance radar apparatus for retrofitting an optical surveillance camera, said surveillance radar apparatus comprising

- a housing for arrangement of the surveillance radar apparatus at the surveillance camera,
- a radar sensor that emits and receives electromagnetic radiation, said radar sensor having a second field of view, and wherein said first field of view is variable with respect to said second field of view.

According to still further aspects a computer program comprising program means for causing a computer to carry out the steps of the method disclosed herein, when said computer program is carried out on a computer, as well as a non-transitory computer-readable recording medium that stores therein a computer program product, which, when executed by a processor, causes the method disclosed herein to be performed are provided.

Preferred embodiments are defined in the dependent claims. It shall be understood that the claimed surveillance radar apparatus for retrofitting a surveillance camera, the claimed surveillance method, the claimed computer program and the claimed computer-readable recording medium have similar and/or identical preferred embodiments as the claimed surveillance apparatus and as defined in the dependent claims.

The present disclosure is based on the idea to provide additional sensing means, i.e., a radar sensor, that complements surveillance with an optical camera. A radar sensor can work in certain scenarios where an optical sensor has difficulties, such as adverse weather or visual conditions, for example, snowfall, fog, smoke, sandstorm, heavy rain or poor illumination or darkness. Moreover, a radar sensor can still operate after vandalism to the optical system. Synergy effects are provided by jointly evaluating the images captured by the (high-resolution) optical camera and the received electromagnetic radiation by the radar sensor.

The field of view of an optical camera that captures images based on received light is typically limited to a confined angular range. Attempts to widen the field of view of an optical camera exist, for example, in form of a fish-eye lens. While such optical elements significantly broaden the field of view of the optical camera, they also create a significantly distorted image of the observed scene. This makes image analyses difficult for an operator that monitors the images captured by the surveillance camera, if no additional correction and post-processing is applied.

The surveillance apparatus according to the present disclosure uses a different approach by combining an optical camera that captures images based on received light, and a radar sensor, that emits and receives electromagnetic radiation. The optical camera has a first field of view and the radar sensor has a second field of view. The first field of view is variable with respect to the second field of view. Alternatively, the second field of view differs from the first field of view. For example, the first field of view of the optical camera covers an angular range of about 50-80° to avoid substantial image distortions, whereas the second field of view of the radar sensor covers an angular range of at least 90°, preferably 180°, or even a full 360°. Thus, the field of view of the radar sensor is larger than the field of view of the optical camera and thereby monitors a wider field of view. However, the information gained from the radar sensor is often not sufficient for surveillance applications since often a high-resolution optical image is desired. Therefore, the field of view of the optical camera is variable with respect to the field of view of the radar sensor. In particular, the size and/or orientation of the first field of view are variable with respect to the second field of view. For example, an object can be identified with the radar sensor and the field of view of the optical camera is adjusted to cover said object. This is particularly beneficial if an object that is initially not covered by the field of view of the optical camera is now detected in the field of view of the radar sensor.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1A:
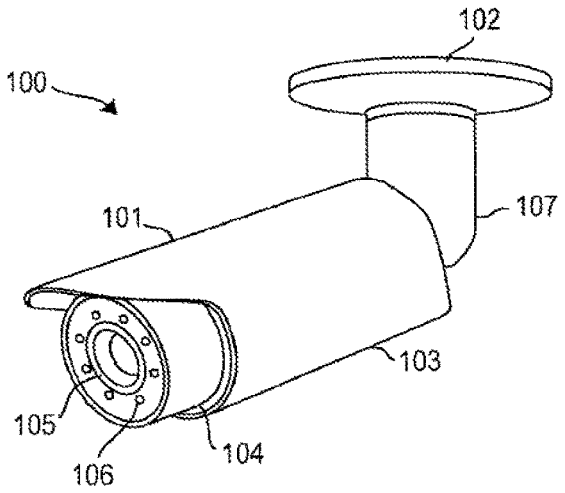
Fig. 1A (background art)
FIG. 1A shows a first embodiment of an optical surveillance camera.

Referring now to the drawings, wherein like reference numerals designate identical or corresponding parts throughout the several views, FIG. 1 shows a surveillance apparatus 100 comprising an optical camera 101 and a mount 102 for mounting the camera, for example, to a wall, ceiling or pole. The optical camera is a security camera that comprises a housing 103 and a camera objective 104. Optionally, the camera objective 104 is a zoom objective for magnifying a scenery. The front part of the optical camera 101 comprises a camera cover 105 for protecting the camera objective 104. The housing 103 together with the camera cover 105 provide a certain degree of protection against vandalism. However, an optical camera is still vulnerable to attacks on the optical system. Such attacks include, but are not limited to, spray and paint attacks, gluing or sticking optically non-transparent materials on the camera cover 105 or blinding the camera by a laser.

The optical camera 101 of the surveillance apparatus 100 optionally features a light source for illuminating a region of interest in front of the camera. In this example, the camera 101 comprises a ring of infrared (IR) light emitting diodes (LEDs) 106 for illuminating the region of interest with non-visible light. To a certain extent, this enables unrecognized surveillance and surveillance in darkness over a limited distance.

Further optionally, the surveillance apparatus 100 comprises an actor 107 for moving the camera 101. By moving the camera, a larger area can be monitored. However the movement speed is limited. Different areas cannot be monitored at the same time but have to be monitored sequentially.

Figure 1B:
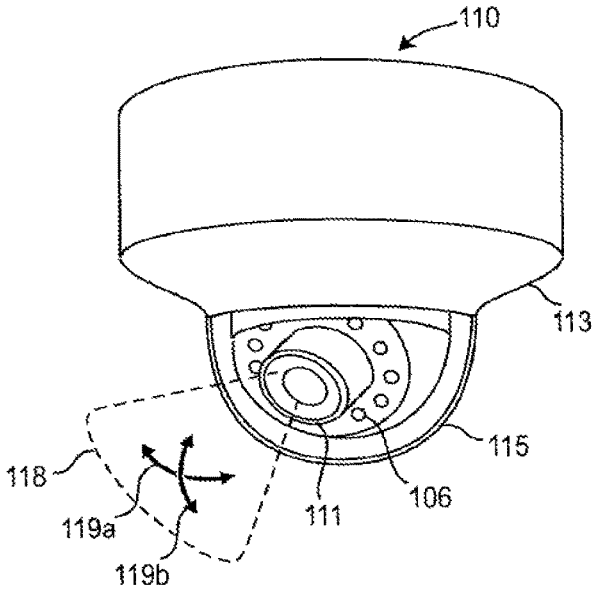
Fig. 1B (background art)
FIG. 1B shows a second embodiment of an optical surveillance camera.

FIG. 1B shows a second embodiment of a surveillance apparatus 110 comprising an optical camera 111. In this embodiment, the surveillance apparatus 110 has a housing 113 with a substantially circular outline. This housing 113 is typically mounted to or into a ceiling. The surveillance apparatus 110 comprises a translucent camera cover 115 wherein the optical camera 111 is arranged. In this embodiment, the camera cover 115 comprises a substantially hemispheric camera dome. However, the camera cover is not limited in this respect.

The field of view 118 of the optical camera 111 defines the region that is covered and thus imaged by the optical camera 111. In order to increase the area that can be monitored with the surveillance apparatus 110, the surveillance apparatus 110 can further comprise a first actor and a second actor to pan 119*a* and tilt 119*b* the optical camera 111.

Figure 2:
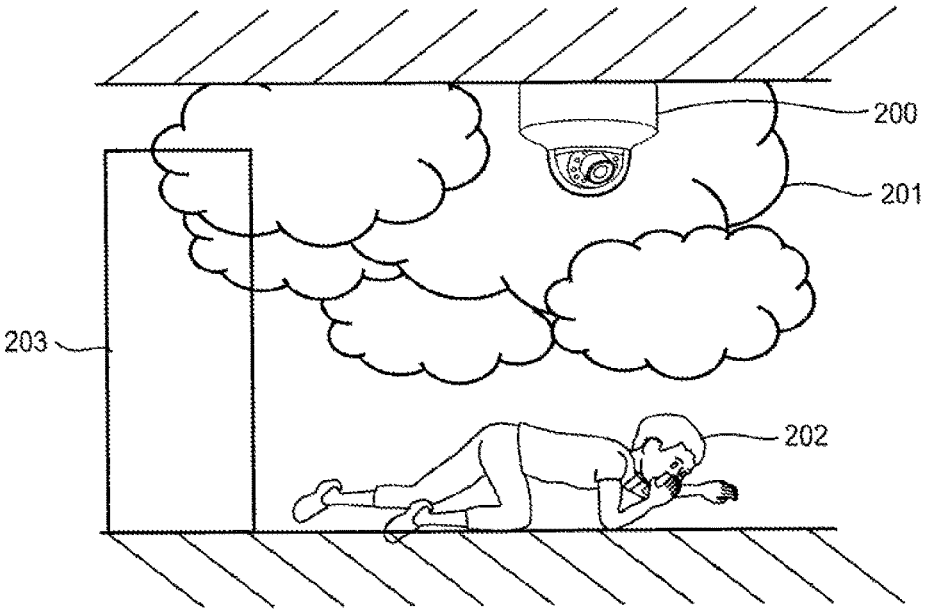
FIG. 2 shows an application scenario of a surveillance apparatus according to the present disclosure.

FIG. 2 shows an application scenario that illustrates the limitations of a surveillance apparatus 200 purely relying on an optical camera. The optical camera cannot see through smoke 201, dust or fog, for example in case of a fire. Thus, a subject 202 is not detected and can, therefore, not be guided to the nearest safe emergency exit 203.

Figure 3:
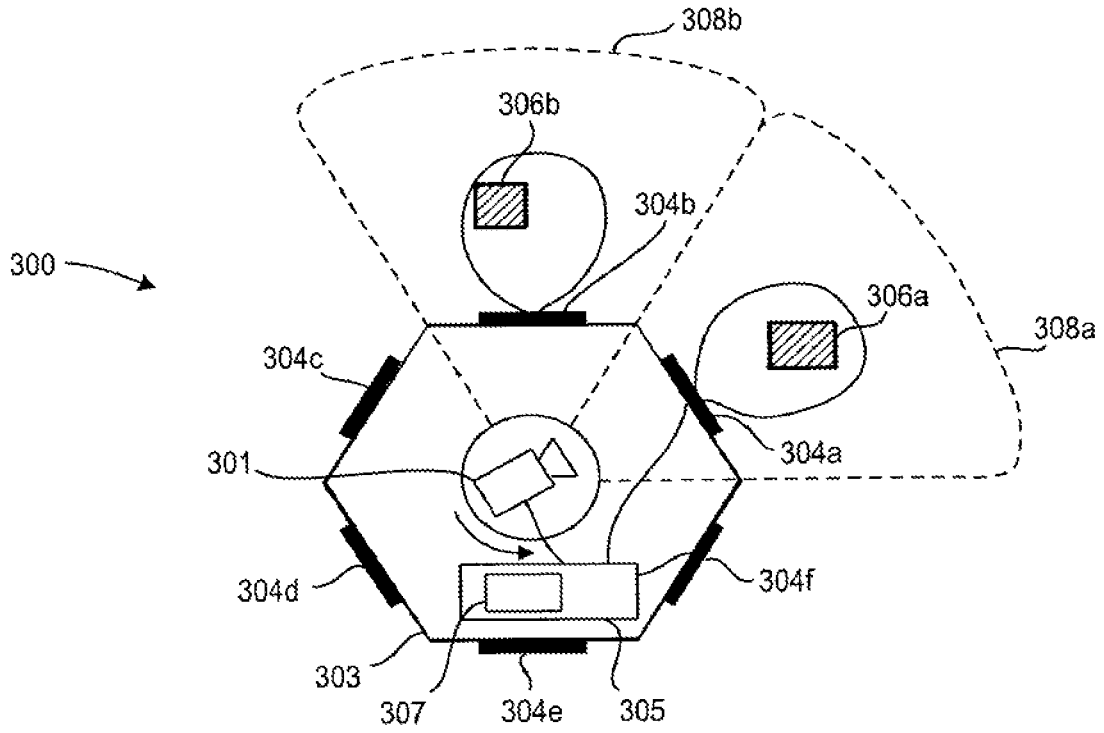
FIG. 3 shows a first embodiment of a surveillance apparatus according to the present disclosure.

FIG. 3 shows an embodiment of a surveillance apparatus 300 according to an aspect of the present disclosure comprising an optical camera 301 that captures images based on received light, and a radar sensor that emits and receives electromagnetic radiation. Advantageously, the radar sensor operates in the millimeter-wave frequency band. This embodiment shows a top view of a surveillance apparatus 300 having a housing 303 with a polygonal outline, in this example hexagonal outline.

The camera 301 is arranged at the center of the housing, for example, a dome-type camera as discussed with reference to FIG. 1B. The optical camera 301 has a first field of view 308*a*. In this embodiment, the radar sensor comprises a plurality of antenna elements 304*a*-304*f* (in particular of single antennas) arranged on the periphery of the surveillance apparatus 300. Individual antenna elements 304*a*-304*f* are provided on the sectored camera outline. Each antenna element 304*a*-304*f* is connected to a radar front end system 305 of the radar sensor. The field of view of the radar sensor with its antenna elements covers the entire surrounding of the surveillance apparatus 300, i.e. a 360° field of view. Furthermore, the surveillance apparatus 300 can identify the sector of the radar sensor in which an object 306*a*, 306*b* is located by evaluating the antenna elements 304*a*, 306*b* corresponding to said sector.

In a first configuration, the field of view 308*a* of the optical camera 301 corresponds to the portion of the field of view of the radar sensor that is covered by the antenna element 304*a*. Even if the view of the optical camera 301 is obscured by smoke, the radar sensor can still detect the object 306*a*, since the frequency spectrum used for the electromagnetic radiation of the radar sensor penetrates through smoke. For example with reference to the application scenario in FIG. 2, the radar sensor of the surveillance apparatus indicates a trapped person and guides rescue personnel to primarily search for victims in rooms where the radar has indicated a trapped person. Furthermore, millimeter-waves can penetrate dust or fog, as well as thin layers of cardboard, wood, paint, cloth and the like. Hence, the surveillance apparatus remains operable after an attack on the optical camera 301.

Using a radar sensor employing a frequency-modulated continuous wave (FMCW) modulation scheme or stepped CW allows ranging and relative speed detection. Measurement schemes, such as pulsed radar, can be used in the alternative. In principle, a single antenna is sufficient for ranging, such that in a most basic configuration, a single antenna 304*a* can be used. Thus, the range and speed of the target 306*a* can be determined.

The field of view of the radar sensor that emits and receives electromagnetic radiation comprises the field of view of the individual antenna elements 304*a*-304*f*. In the configuration shown in FIG. 3, each of the six antenna elements 304*a*-304*f* covers an angular range of 60°, such that the entire surrounding of the surveillance apparatus 300 can be monitored. The field of view 308*a* of the optical camera 301 that captures images based on received light in this example is limited to 60°. However, advantageously, the field of view of the optical camera 301 is variable with respect to the field of view of the radar sensor. In particular, the size and/or orientation of the field of view of the camera are variable with respect to the field of view of the radar sensor. This can be achieved by having an optical camera 301 that is movable with respect to the radar sensor. For example, the optical camera 301 is a dome-type camera as disclosed in FIG. 1B that further comprises an actuator that enables a pan and/or tilt movement. For example, the optical camera 301 can be oriented in a first position to cover the field of view 308*a* and can be moved to a second position to cover the field of view 308*b*.

In a further scenario, the optical camera 301 is oriented to cover the field of view 308*a* with the object 306*a*. The radar sensor covering the entire 360° field of view detects an object 306*b* in the sector of antenna element 304*b*. The surveillance apparatus 300 can comprise a control unit 307 as part of the radar front end system 305 (as shown in FIG. 3) or as a separate element for controlling the optical camera 301 based on radar information of the radar sensor. In this example, the direction of the optical camera is controlled based on the information from the radar that an object has been detected in the sector corresponding to antenna element 304*b*. Thus, the optical camera 301 is rotated towards the sector, wherein the second object 306*b* has been detected. Thereby, the second detected object 306*b* can be subject to a closer visual analysis, in particular with a high-resolution optical camera 301. Further, this embodiment may be used to control the optical camera (based on information from the radar) to focus (or zoom) on a certain depth (range) where an object is expected or has been detected (by the radar).

Advantageously, this control of the optical camera 301 can be automated, such that a single optical camera 301 having a limited field of view 308*a*, 308*b* can be used to cover an extended area, in this example the entire surrounding of the surveillance apparatus. Furthermore, the system cost can be lowered by combining the radar functionality for coarse monitoring of an entire area with a selective high-resolution monitoring of only limited parts of the area. The high resolution monitoring is triggered, if an object has been detected by the radar sensor.

The housing 303 accommodates the electronics of the surveillance apparatus 300. In FIG. 3 the electronics, in particular any printed circuit boards including the antenna elements 304*a*-304*f*, comprises planar elements which are arranged as a hexagonal structure corresponding to the housing 303. As an alternative to 2-dimensional antenna elements, 3-dimensional antenna elements can also be used. Alternative structure types of the housing could also be envisaged, i.e., quadratic shape, octagonal shape, or also a cylindrical shape as currently employed for most security cameras. An arrangement of the electronics, in particular a shape of the printed circuit boards or antenna elements can correspond to a part of said housing.

Figure 4A:
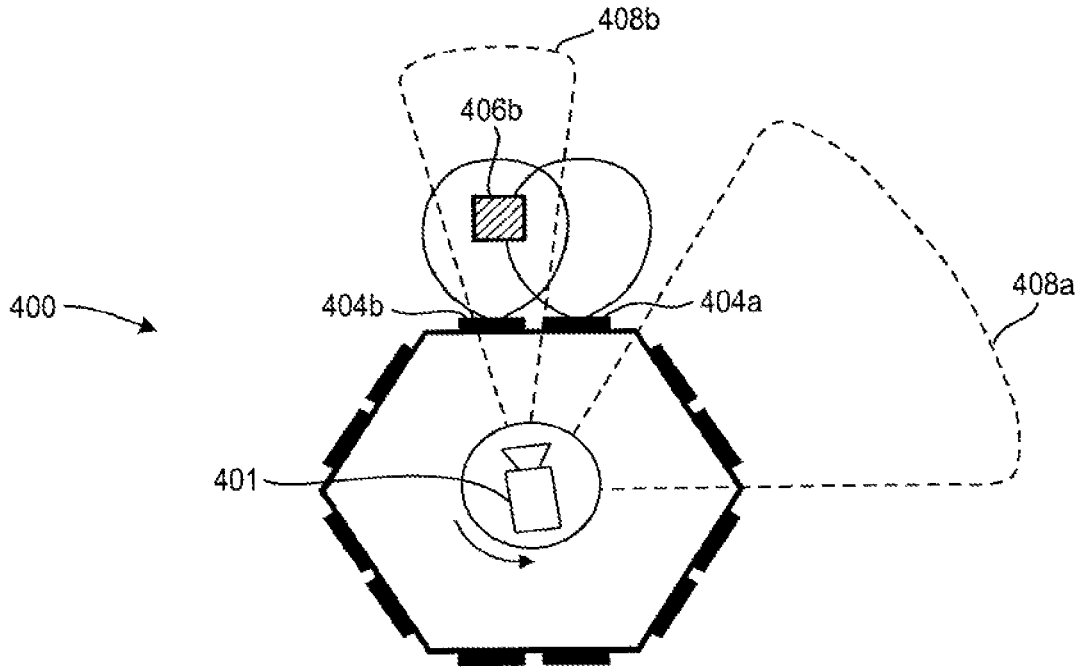
FIG. 4A shows a second embodiment of a surveillance apparatus according to the present disclosure.

FIG. 4A shows a further embodiment of a surveillance apparatus 400 according to the present disclosure. In addition to having an antenna element 304 at each side of the hexagonal outline, as depicted in FIG. 3, the surveillance apparatus 400 features additional antenna elements, i.e. a plurality of antenna elements (that may form an antenna array) at each side of the outline. Using these additional antenna elements, the angle of an object 406*b* can be determined with respect to the antenna elements 404*a* and 404*b*. The angle of arrival can be determined, for example, by using the radar monopulse principles. For example, electromagnetic radiation is emitted by at least one of the antenna elements 404*a* and 404*b*. By applying the amplitude or phase monopulse principle to the reflected signal received by the two antenna elements, the direction of the object 406*b* can be determined. The distance of the target can be determined, for example, by evaluating a beat frequency (the difference of the sent and received signal) as known from FMCW radar systems. Alternatively, a pulse radar can be used for determining the distance.

Figure 4B:
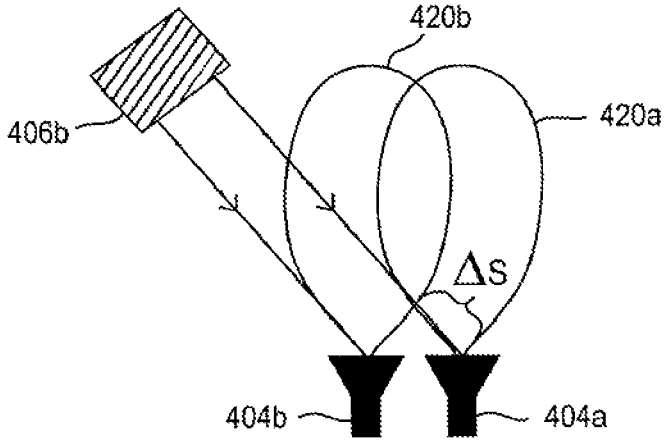
FIGS. 4B to 4D illustrate examples of determining an angle of arrival.

The range and/or direction of the object 406*b* can be determined by use of the generally known principles of interferometry or phase monopulse. The principle of phase monopulse is sketched in FIG. 4B. The object 406*b* is oriented at an angle φ with respect to the two antenna elements 404*a* and 404*b*. The distance from the object 406*b* to antenna element 404*a* differs from the object 406*b* to the distance from antenna element 404*b* by a path difference Δs. Because of this path difference, the antenna element 404*b* receives a signal reflected from the object 406*b* with a time delay corresponding to the path difference. If a modulated signal is emitted towards and reflected from the target, the phase difference of the signals received with antenna elements 404*b* and 404*a* represents the path difference and thus the angle of incidence of the received signal. Thus, modulated electromagnetic radiation, for example sinusoidal intensity modulated electromagnetic radiation, is emitted by at least one radar antenna, and the phase difference of electromagnetic radiation received with antenna elements 404*a* and 404*b* is evaluated. Based on the phase difference between the two signals detected with the two antenna elements 404*a* and 404*b*, the angle of arrival (AOA, φ) towards the object 406*b* can be determined. Alternatively, a pulse radar can be used for determining the path difference.

Figure 4C:
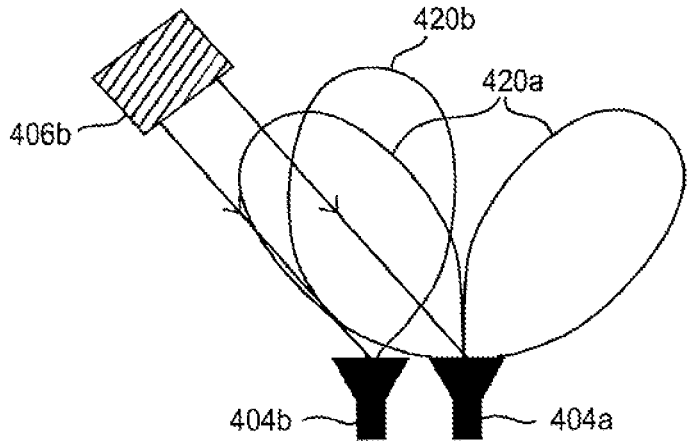
Figure 4D:
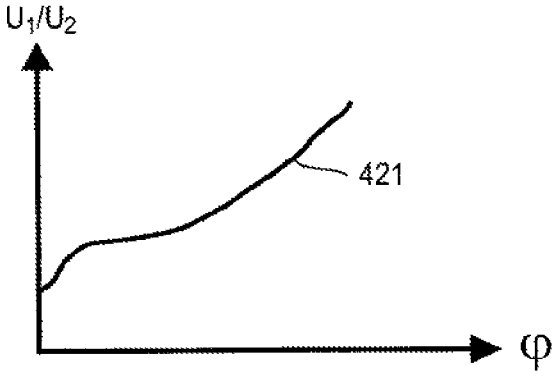

FIG. 4C illustrates the principle of amplitude monopulse for determining the angle of arrival. At least two antenna elements 404*a*, 404*b* with differently shaped antenna patterns 420*a*, 420*b* are used. The amplitude of the signal received with antenna element 404*a* with antenna pattern 420*a* is denoted $U_1$. The amplitude of the signal received with antenna element 404*b* with antenna pattern 420*b* is denoted $U_2$. The ratio of the amplitudes of the received signals $U_1/U_2$ is computed. Because of the different antenna patterns 420*a*, 420*a*, the ratio of the amplitudes of the received signals $U_1/U_2$ depends on the angle φ of the object 406*b* with respect to the two antenna elements 404*a* and 404*b*. In FIG. 4D, the ratio $U_1/U_2$ is plotted as a function of the angle of arrival φ. Preferably, the curve 421 is a monotonic function to avoid ambiguities in the estimated angle of arrival. Furthermore, ambiguity has to be taken into account with respect to the number of objects for which an angle of arrival can be determined. With N antenna elements, the angle of arrival for N−1 objects can be determined. In case of two antenna elements, the angle of arrival for one object 406*b* can be determined.

An alternative approach for determining the direction to an object is described with reference to FIG. 5A. In this embodiment, a radar sensor with a single narrow beam antenna 504 having a narrow field of view 509 is used. The housing 503 comprises a rotatable portion 510 comprising the radar sensor with antenna 504. The rotatable portion 510 rotates around an optical camera 501. In general, the field of view 504 of the radar sensor is moved with respect to the field of view 508*a* of the camera. The optical camera 501 can be for example a dome-type camera as depicted in FIG. 1B, a camera as depicted in FIG. 1A, or any other type of movable or fixed camera. In this example, the camera is fixed.

Figure 5A:
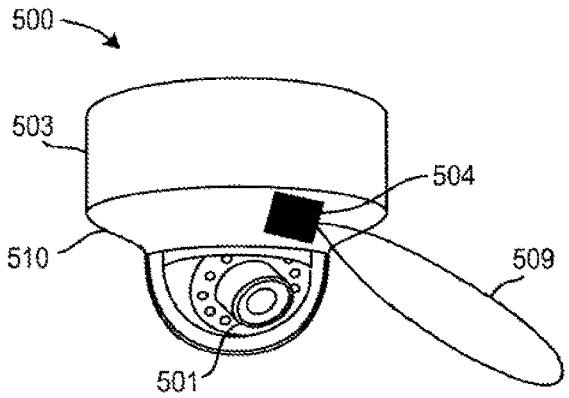
FIGS. 5A and 5B show a third embodiment of a surveillance apparatus according to the present disclosure.
Figure 5B:
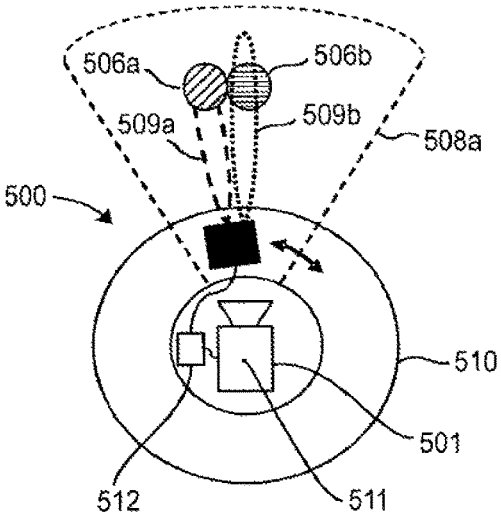

FIG. 5B illustrates beam scanning with the surveillance apparatus 500 of FIG. 5A. The directive antenna 504 including a radio frequency (RF) front end is implemented on a printed circuit board (PCB) which rotates around a center axis 511 of the housing 503. The rotation can be confined to a limited angular range, for example an angular range corresponding to the field of view 508*a* of the optical camera 501. Alternatively, the angle of rotation can be +/−180° or continuously spinning.

In case of +/−180° scanning, a flexible cable interconnect can be used between the static housing 503 and the movable part 510 including the antenna element 504. For the case of a continuously scanning system, a rotary joint is required that may optionally comprise a filter for radio frequency signals (RF), DC signals, intermediate frequency signals (IF), and the like. Alternatively, multiple slip rings for providing a connection between the static housing 503 and the moving parts 510 can be employed.

FIG. 5B further illustrates a very important use case for practical surveillance applications. The surveillance apparatus 500 further comprises processing circuitry 512 for processing the captured images of the optical camera 511 and the received electromagnetic radiation of the radar sensor, received with the antenna element 504, and providing an indication of the detection of the presence of one or more objects 506*a*, 506*b*. In particular, the processing circuitry can verify the detection of an object 506*a*, 506*b* in the captured images of the optical camera 501 or in the received electromagnetic radiation of the radar sensor based on the received electromagnetic radiation of the radar sensor or the captured images of the optical camera, respectively. In other words, the processing circuitry 512 may verify the detection of an object 506*a*, 506*b* in the captured images of the optical camera 501 by making a plausibility check using the received electromagnetic radiation of the radar sensor and/or the processed radar information. Alternatively, the processing unit 512 may verify the detection of an object 506*a*, 506*b* in the received electromagnetic radiation of the radar sensor based on the captured images of the optical camera 501. Furthermore, the processing circuitry 512 may provide an indication of whether two persons 506*a*, 506*b* identified in the captured images of the optical camera are actually two persons or one person and his or her shadow by evaluating distance information to the two persons based on the received electromagnetic radiation of the radar sensor. This use case is illustrated with respect to FIG. 5B.

The processing circuitry 512 identifies a first object 506*a* and a second object 506*b* in the field of view 508*a* of the optical camera 501. For example, the processing circuitry performs image analysis on the captured image and identifies two dark spots as objects 506*a* and 506*b*. More advanced image processing algorithms can of course be employed that identify the outline of a person in both objects 506*a* and 506*b*. In addition to this result from the optical analysis, information acquired using the radar sensor with narrow beam antenna 504 can be used.

For example, the distances corresponding to the directions of objects 506*a* and 506*b* are evaluated. In the optical image, a person and its shadow may be falsely identified as two persons. However, using the information from the radar sensor, it can be clearly identified whether there are actually two persons or whether there is one person (a short distance is measured) and his shadow. For the case of a shadow, the distance measured with the radar sensor does not correspond to the distance of the object expected from the image captured by the optical camera. This use case is very important for counting people, for example to ensure that all kids have left a fun park or that all customers have left a shop or that everybody has left a danger zone.

Figure 6A:
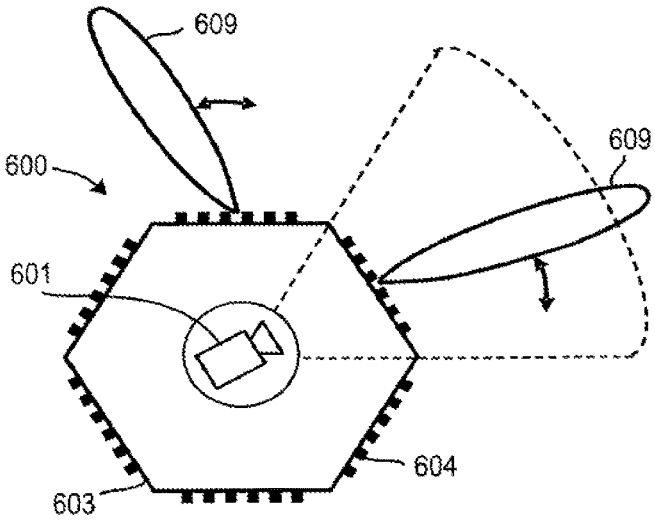
FIGS. 6A and 6B show a fourth embodiment of a surveillance apparatus according to the present disclosure.
Figure 6B:
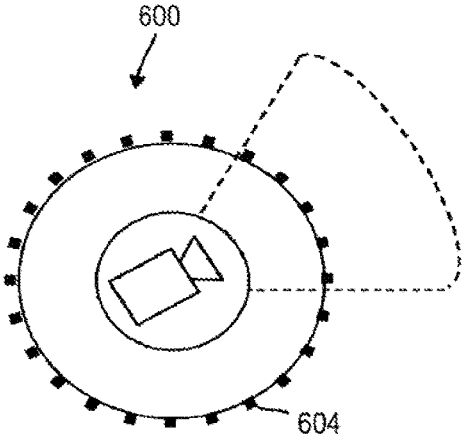

FIGS. 6A and 6B show an alternative to a mechanically scanning system. The acquisition speed of a mechanical scanning system depends on the scanning speed, i.e. the scan time for one full 360° scan or for multiple, for example 10-100, full 360° scans for a rotating or spinning system. FIGS. 6A and 6B show full electronic scanning systems, preferably using analog beam forming like phased array or digital beam forming or any other type of beam forming based on multiple, individual antenna elements. Such an electronic scanning system can yield multiple thousands of different beams per second. In case of electronic beam forming, no more moving parts are needed. Thus, electronic beam forming can increase the reliability of the system.

The surveillance apparatus 600 in FIG. 6A comprises an optical camera 601 in the center of a hexagonal housing 603. A plurality of antenna elements 604 are arranged on the periphery of the surveillance apparatus 600. In the shown example, a narrow antenna beam of electromagnetic radiation is emitted at each side of the hexagonal housing 603. A side of the hexagonal outline is referred to as a sector. Each sector can be scanned by the antennas, for example in the range of +/−30° for a hexagonal shape or +/−22.5° for an octagonal shape, which results in a full 360° field of view. Alternatively, different scanning angles, for example overlapping scanning angles to provide redundancy, are provided.

FIG. 6B shows an alternative embodiment of the surveillance apparatus 600 according to the present disclosure wherein the antenna elements 604 are arranged on a circular outline of the surveillance apparatus 600.

According to a further aspect of the disclosure, the beam forming, for example digital beam forming with MIMO antenna elements, can be used to generate different beam forms. For example, a wide antenna beam similar to FIG. 3 is emitted in a first configuration. In case that an object is detected with said wide beam, the antenna array switches to a scanning mode wherein the narrow antenna beam scans the scenery to determine an exact position of the detected object. Furthermore multiple narrow beams can be generated at the same time.

The previous embodiments have illustrated scanning an antenna beam in one direction, i.e. in the azimuth plane. In order to monitor a room in three dimensions, however, the radar sensor can scan in the elevation plane in addition to the azimuth plane.

Figure 7A:
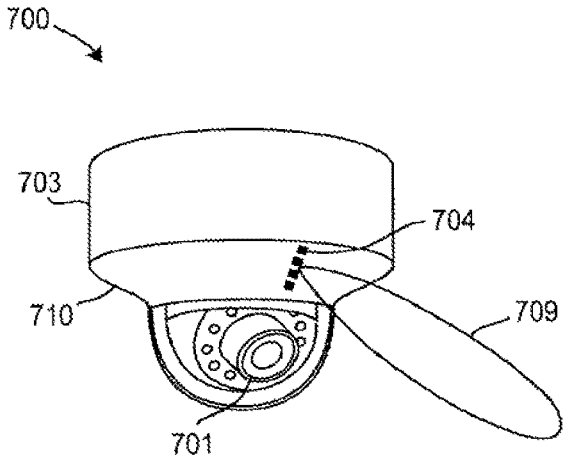
FIGS. 7A and 7B show a fifth embodiment of a surveillance apparatus according to the present disclosure.
Figure 7B:
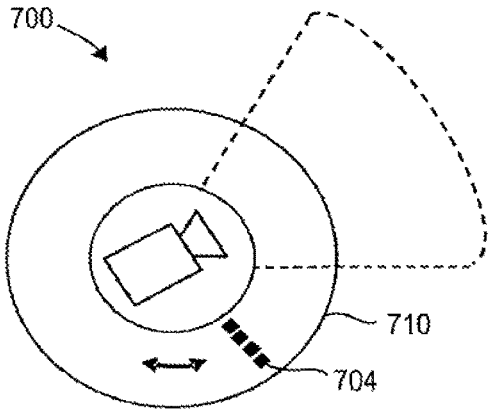

The azimuth and the elevation can be monitored with a mechanical scanning radar system, a hybrid mechanical/electronic scanning radar system, or a purely electronic scanning radar system. FIGS. 7A and 7A illustrate a hybrid mechanical/electronic scanner. In this example, the surveillance apparatus shown in FIG. 5A is modified by replacing the single antenna element 504 by a plurality of antenna elements 704. The surveillance apparatus 700 comprises an optical camera 701, a common housing 703 and a radar sensor with antennas 704. The antenna elements 704 are arranged on a rotatable part 710 of the housing 703 adapted to rotate around the optical camera 701 or generally to perform a rotating movement for scanning in the azimuth plane. The elevation plane, in turn, is covered by the linear array of antenna elements 704 for electronically scanning the elevation plane.

In the example shown in FIG. 7A, the antenna array is implemented on a printed circuit board which is mounted in the rotatable ring 710 at an angle of 45° with respect to the axis of rotation. The 1-dimensional array allows beam forming in a direction orthogonally oriented to a rotation direction. By rotating the ring, 2-dimensional scanning is achieved. In this example, the scanning range in the elevation is +/−45°. Thereby, the entire hemisphere below the surveillance apparatus 700 is covered by the combination of mechanical scanning in the azimuth plane and electronic scanning by beam steering in the elevation plane. The electronic beam forming can be implemented as a one-dimensional, sparse MIMO array.

Figure 8:
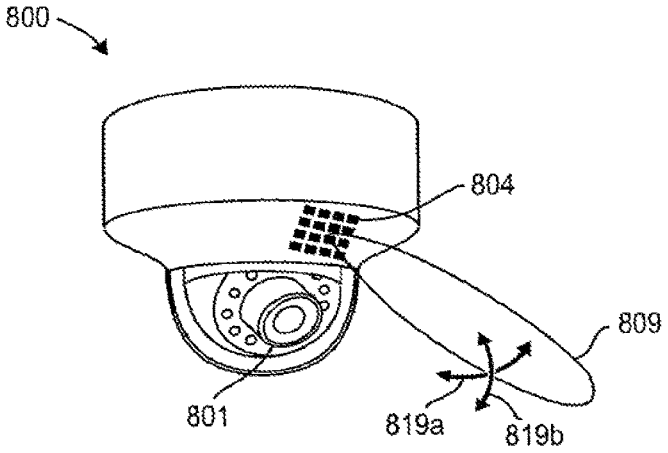
FIG. 8 shows a sixth embodiment of a surveillance apparatus according to the present disclosure.

FIG. 8 shows an alternative embodiment of the surveillance apparatus 800 according to the present disclosure that provides electronic beam scanning both in azimuth and elevation. The surveillance apparatus 800 comprises an optical camera 801 and a radar sensor comprising a two-dimensional array of antenna elements 804. This arrangement enables angular scanning in two dimensions, i.e. in azimuth and elevation, as well as determining the range at each antenna position. The antenna elements can be distributed over the outline of the camera housing.

In an alternative embodiment, the outline of the surveillance apparatus is a polygonal shape. Thereby, the two-dimensional antenna arrays can be implemented, for example, as patch antenna arrays on individual printed circuit boards that are placed at the sides of the polygonal shape. This reduces fabrication costs.

A further aspect of the present disclosure relates to retrofitting an optical surveillance camera, as for example shown in FIGS. 1A and 1B, having a first field of view with a surveillance radar apparatus. In other words, the radar modality can be supplied directly with the optical surveillance camera as disclosed in the previous embodiments, or can be supplied as an add-on. Thereby, an optical camera can be provided with the radar sensor having a second field of view at a later point in time.

Optionally, the surveillance radar apparatus includes further functionalities, such as a converter for converting analog video signals of an existing analog optical camera to digital video signals, for example for connecting the existing analog optical camera via the surveillance radar apparatus to an IP network.

Figure 9A:
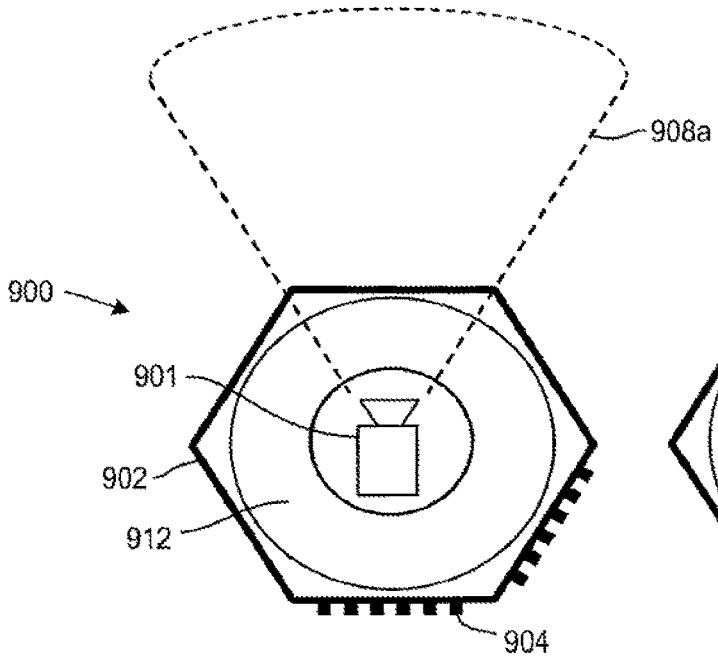
FIGS. 9A to 9C show an embodiment of a surveillance radar apparatus for retrofitting a surveillance camera.
Figure 9B:
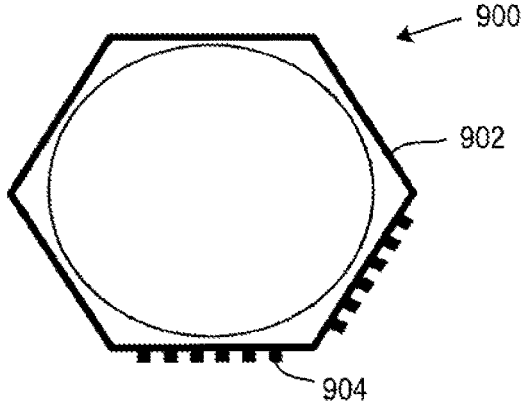
Figure 9C:
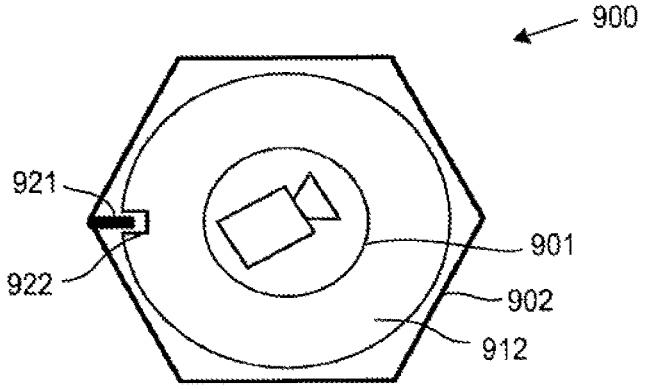

FIGS. 9A to 9C illustrate an embodiment of a surveillance radar apparatus 900 for retrofitting an optical camera 901. The surveillance radar apparatus 900 in this example can be sort of a 'jacket' with a polygonal housing 902 which is put around the cylindrical housing 912 of the camera 901. In this non-limiting example, the housing 902 of the surveillance radar apparatus encompasses the surveillance camera. The surveillance radar apparatus 900 for retrofitting the optical surveillance camera is illustrated separately in FIG. 9B. Antenna elements 904 of the radar sensor for emitting and receiving electromagnetic radiation are arranged on the periphery of the housing 902 of the surveillance radar apparatus 900. Thereby, and existing optical camera 901 is provided with a radar sensor having a second field of view.

For example, the antenna elements 904 of the radar sensor cover the entire periphery of the surveillance radar apparatus. The field of view 908*a* of the optical camera 901 is variable with respect to the second field of view provided by the radar sensor, such that the field of view 908*a* can be moved towards an object that has been detected in the received electromagnetic radiation by the radar sensor.

To ensure proper alignment of the optical surveillance camera 901 and the surveillance radar apparatus 900, the housing 902 of the surveillance radar apparatus 900 further comprises an alignment member 921 for aligning a position of the surveillance radar apparatus 900 with respect to the surveillance camera 901. For this purpose, the housing 912 of the surveillance camera 901 comprises a second alignment member 922 for engagement with the alignment member 921 of the housing of the surveillance radar apparatus 900. In this embodiment, the second alignment member 922 of the camera housing 912 is a type of slot or groove where a tapped structure 921 from the housing 902 of the surveillance radar apparatus 900 fits into. Of course, this form fit can also be implemented vice versa. There can also be other embodiments of alignment structures or multiple of them, respectively.

Figure 10:
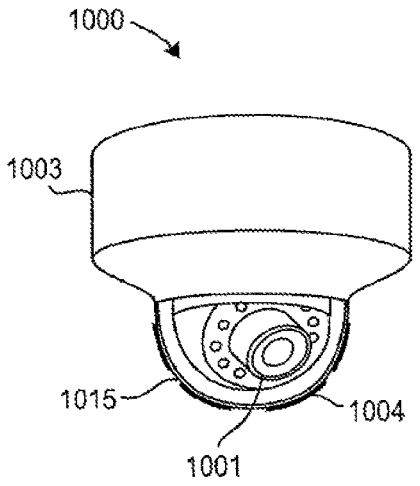
FIG. 10 shows a surveillance apparatus with a camera cover comprising a translucent antenna.

FIG. 10 illustrates a further embodiment of the surveillance apparatus 1000 according to the present disclosure. The optical camera 1001 is arranged inside a camera dome 1015 that serves as a camera cover. In contrast to the previous embodiments, the camera dome 1015 comprises the antenna elements 1004 as translucent antenna elements. In this embodiment, the translucent antenna with its translucent antenna elements 1004 comprises several patch antenna elements. In general, the translucent antenna comprises at least one electrically conductive layer which comprises at least one of a translucent electrically conductive material and an electrically conductive mesh structure. An example of an optically translucent and electrically conductive material is indium tin oxide (ITO), however, any other optically translucent and electrically conductive material could be used as well.

A conventional camera cover usually only comprises one translucent layer, for example a translucent dome made from glass or a transparent polymer. Optionally, the camera cover comprises an anti-reflective coating, a tinting, or a one-way mirror, in order to obscure the direction the camera is pointing at.

Figure 11:
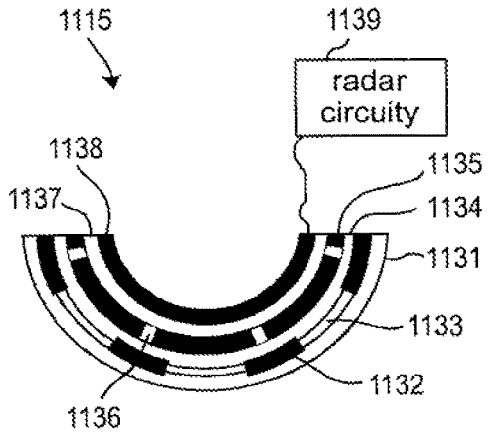
FIG. 11 shows a cross section of a camera cover comprising a translucent antenna.

FIG. 11 shows a cross section of a camera cover 1115 comprising a translucent antenna. The translucent antenna according to an aspect of the present disclosure comprises several layers. The example shown in FIG. 11 comprises an optional outer protection layer 1131, for example made of glass or a transparent polymer. This protection layer 1131 may further optionally comprise a coating. The outer protection layer 1131 is followed by a second layer comprising several patch antenna elements 1132, for example ITO patch antennas that are separated by spacers 1133. The separation of the antennas is typically in the range of 0.4 to 1.5 times the wavelength lambda. The third layer in this example is a translucent dome 1134, for example made from glass or a translucent polymer, that provides mechanical stability to the camera cover. This layer is made from a dielectric, isolating material. The fourth layer in this example is a ground plane, in particular a slotted ground plane comprising several conductive ground plane elements 1135 and slots 1136. The slots 1136 are arranged underneath or in close proximity to the patch antenna elements 1132. A fifth layer is a translucent spacer 1137, which separates the slotted ground plane from the sixth layer comprising microstrip feed lines 1138 for feeding the patch antenna elements 1132 via the slots 1136 of the slotted ground plane 1135. The microstrip feed lines 1138 are connected to a radar circuitry 1139 as illustrated in more detail with reference to FIG. 12. The sequence of layers in this example can optionally be changed and layers omitted. For example, the outer layer may provide mechanical stability to the camera dome instead of the third layer in the example above. Further alternatively, a different feed structure with or without a slotted ground plane layer may be used, for example a differential wiring of the individual patch antenna elements.

According to an embodiment of the translucent antenna, the patch antennas 1132 make up a conformal patch antenna array. The array can cover the entire hemispherical camera cover and can consist of multiple arrays of patch antenna elements that are arranged for observing different sectors. Alternatively, individually controlling the individual patch antenna elements is possible to form a hemispherical phased antenna array. A corresponding feeding network for routing to the radar circuitry 1139 for feeding the individual patch antenna elements is then provided with the corresponding individual microstrip feed lines 1138 and power dividers for individually feeding the antenna elements. The same holds true in the receiving path.

Figure 12:
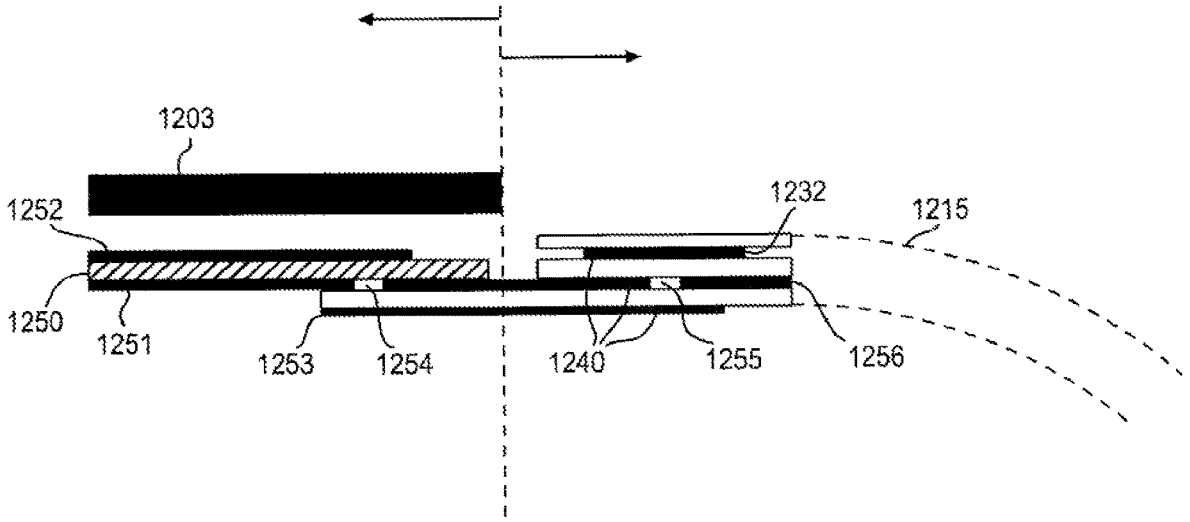
FIG. 12 shows a cross section of a translucent antenna and feeding structure.

FIG. 12 illustrates the coupling of he translucent antenna of the camera 1215 cover to the base of the surveillance apparatus with the housing 1203 of the surveillance apparatus 1000. The translucent camera cover 1215 including the patch antenna elements 1232 is illustrated to the right side of the dashed line, whereas the base of the surveillance apparatus is illustrated to the left side of the dashed line in FIG. 12.

In this embodiment, conductive layers of the translucent antenna are preferably implemented by electrically conductive ITO (Indium-Tin-Oxide) layers 1240. As a further alternative, conductive layers of the translucent antenna elements comprise AgHT (silver coated polyester film). Alternatively, printed patch antennas, which are approximated by wire meshes, can be used. This methodology does not need any special type of material. Standard metallic conductors such as copper, gold, chrome, etc. can be employed. By perforating large metal areas of the antenna, a high optical transparency can be achieved. In a wire mesh the metal grid is typically space by 0.01 . . . 0.1 lambda (i.e. 0.01 . . . 0.1 times the used wavelength). The thickness of the metal strips can be as small as 0.01 lambda.

The conductive layers 1240 are separated by dielectric layers made from glass or, alternatively, a translucent polymer that is not electrically conductive but can serve as a dielectric. Of course, the translucent antenna can be implemented using different layer structures, however, the layer structure preferably comprises a first electrically conductive layer comprising a ground plane and a second electrically conductive layer comprising an antenna element.

For example, the base of the surveillance apparatus 1000 comprises radar circuitry, in particular, a printed circuit board (PCB) 1250 further comprising a ground plane 1251 and a microstrip line 1252. The microstrip line 1252 feeds the patch antenna elements 1232 via the shown structure. The ground plane 1251 further comprises a slot 1254 for coupling a signal from the microstrip line 1252 of the PCB to the microstrip line 1253 which connects the printed circuit board 1250 with the translucent antenna cover 1215 comprising the patch antenna elements 1232. The patch antenna element 1232 is fed by the microstrip line 1253 via further slots 1255 in the ground plane 1256 which is at least electrically connected to the ground plane 1251. In other words, an interconnection between the printed circuit board of the radar circuitry and the microstrip feed lines 1253, 1138 of the translucent camera cover 1215 is realized by a coupling structure which interconnects a microstrip line 1252 on the printed circuit board with a microstrip line 1253 on the translucent camera dome.

Figure 13:
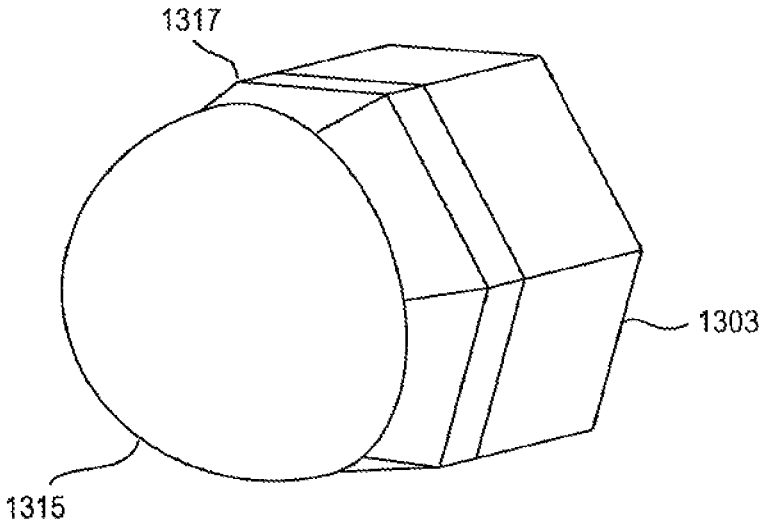
FIG. 13 shows a perspective view of a housing incorporating an optical camera as well as conformal translucent antennas fed by printed RF circuit boards.

FIG. 13 illustrates a further embodiment of the surveillance apparatus according to the present disclosure comprising a hexagonal base 1303 and a hemispherical optically translucent camera cover comprising antenna elements. The camera cover comprising the antenna elements is also referred to as a radome 1315. The radome has a continuous outline from the hemisphere to the hexagonal shape of the camera base. A transition section 1317 connects the radome with the camera base. For this purpose, the transition section may comprise antenna feed lines for connecting the transparent antenna elements to RF circuitry. The RF circuitry may comprise planar PCBS that are hosted planar sections of the housing. In an alternative embodiment, the antenna elements of the radar sensor are arranged in the transition section 1317.

Thus, the foregoing discussion discloses and describes merely exemplary embodiments of the present disclosure. As will be understood by those skilled in the art, the present disclosure may be embodied in other specific forms without departing from the spirit or essential characteristics thereof. Accordingly, the disclosure of the present disclosure is intended to be illustrative, but not limiting of the scope of the disclosure, as well as other claims. The disclosure, including any readily discernible variants of the teachings herein, defines, in part, the scope of the foregoing claim terminology such that no inventive subject matter is dedicated to the public.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

In so far embodiments of the disclosure have been described as being implemented, at least in part, by software-controlled data processing apparatus, it will be appreciated that a non-transitory machine-readable medium carrying such software, such as an optical disk, a magnetic disk, semiconductor memory or the like, is also considered to represent an embodiment of the present disclosure. Further, such a software may also be distributed in other forms, such as via the Internet or other wired or wireless telecommunication systems, including fixed-wired logic, for example an ASIC (application-specific integrated circuit) or FPGA (field-programmable gate array).

It follows a list of further embodiments of the disclosed subject matter:

1. A surveillance apparatus comprising
   an optical camera that captures images based on received light, said optical camera having a first field of view,
   a radar sensor that emits and receives electromagnetic radiation, said radar sensor having a second field of view, and wherein said first field of view is variable with respect to said second field of view.

2. The surveillance apparatus according to embodiment 1, wherein size and/or orientation of said first field of view are variable with respect to said second field of view.

3. The surveillance apparatus according to any preceding embodiment, wherein said optical camera is movable with respect to the radar sensor.

4. The surveillance apparatus according to any preceding embodiment, further comprising a control unit that controls the optical camera based on radar information obtained with the radar sensor.

5. The surveillance apparatus according to any preceding embodiment, wherein the optical camera further comprises a translucent camera cover.

6. The surveillance apparatus according to embodiment 5, wherein the camera cover comprises a substantially hemispheric camera done.

7. The surveillance apparatus according to any preceding embodiment, having a polygonal, cylindrical or circular outline.

8. The surveillance apparatus according to any preceding embodiment, wherein the radar sensor comprises an antenna element arranged on the periphery of the surveillance apparatus.

9. The surveillance apparatus according to any preceding embodiment, wherein the radar sensor is adapted to provide at least one of a direction, range and speed of an object relative to the surveillance apparatus.

10. The surveillance apparatus according to embodiment 5, wherein the camera cover further comprises a translucent antenna.

11. The surveillance apparatus according to embodiment 10, wherein the translucent antenna comprises an electrically conductive layer comprising at least one of a translucent electrically conductive material and an electrically conductive mesh structure.

12. The surveillance apparatus according to embodiment 11, wherein a first electrically conductive layer comprises a ground plane and a second electrically conductive layer comprises an antenna element.

13. The surveillance apparatus according to embodiment 12, wherein the ground plane comprises a slot for feeding the antenna element.

14. The surveillance apparatus according to embodiment 11, 12 or 13, wherein the camera cover comprises at least one dielectric layer and two electrically conductive layers.

15. The surveillance apparatus according to embodiment 14, wherein said dielectric layer is made from at least one of glass or a translucent polymer.

16. The surveillance apparatus according to any one of embodiments 10 to 15, further comprising a feed structure comprising a microstrip feed line.

17. The surveillance apparatus according to any preceding embodiment, further comprising processing circuitry that processes the captured images of the optical camera and the received electromagnetic radiation of the radar sensor and providing an indication of the detection of the presence of one or more objects.

18. The surveillance apparatus according to embodiment 17, wherein the processing circuitry verifies the detection an object in the captured images of the optical camera or in the received electromagnetic radiation of the radar sensor based on the received electromagnetic radiation of the radar sensor or the captured images of the optical camera respectively.

19. The surveillance apparatus according to embodiment 18, wherein the processing circuitry provides an indication of whether two persons identified in the captured images of the optical camera are actually two persons or one person and their shadow by evaluating distance information to the two identified persons based on the received electromagnetic radiation of the radar sensor.

20. A surveillance apparatus comprising an optical camera that captures images based on received light, said optical camera having a first field of view, a radar sensor that emits and receives electromagnetic radiation, said radar sensor having a second field of view, and wherein said second field differs from said first field of view.

21. The surveillance apparatus according to embodiment 20, wherein the second field of view is larger than the first field of view.

22. The surveillance apparatus according to embodiment 20 or 21, wherein the second field of view covers an angular range of at least 90°.

23. A surveillance radar apparatus for retrofitting an optical surveillance camera, having a first field of view, comprising a housing for arrangement of the surveillance radar apparatus at the surveillance camera, a radar sensor that emits and receives electromagnetic radiation, said radar sensor having a second field of view, and wherein said first field of view is variable with respect to said second field of view.

24. The surveillance radar apparatus according to embodiment 23, wherein the housing of the surveillance radar apparatus encompasses the surveillance camera.

25. The surveillance radar apparatus according to embodiment 23, wherein said housing of the surveillance radar apparatus further comprises an alignment member for aligning a position of the surveillance radar apparatus with respect to the surveillance camera.

26. A surveillance method comprising the steps of capturing images based on received light with an optical camera, said optical camera having a first field of view, emitting and receiving electromagnetic radiation with a radar sensor, said radar sensor having a second field of view, and wherein said first field of view is variable with respect to said second field of view.

27. A computer program comprising program code means for causing a computer to perform the steps of said method as claimed in embodiment 26 when said computer program is carried out on a computer.

28. A non-transitory computer-readable recording medium that stores therein a computer program product, which, when executed by a processor, causes the method according to embodiment 26 to be performed.

The invention claimed is:

1. A surveillance apparatus comprising:

a housing;

an optical camera included in the housing, the optical camera configured to capture images based on received light, the optical camera having a first field of view of a first size;

an actuator configured to at least pan and tilt the optical camera within the housing; and a radar sensor attached to an outer surface of the housing, the radar sensor configured to emit and receive electromagnetic radiation, the radar sensor having a second field of view of a second size that is greater than the first size, the radar sensor including a plurality of elements each having a third field of view of a size that is substantially similar to the first size and that covers less than an entirety of the second field of view; and circuitry configured to identify that an object has been detected based on electromagnetic radiation received by at least one of the plurality of elements; and control the actuator to move the optical camera so that an orientation of the first field of view enters the third field of view of the at least one of the plurality of elements.

2. The surveillance apparatus according to claim 1, wherein the first size of the first field of view is variable with respect to the second size of the second field of view.

3. The surveillance apparatus according to claim 1, wherein the optical camera is movable with respect to the radar sensor.

4. The surveillance apparatus according to claim 1, wherein:

the circuitry is configured to control the optical camera based on radar information obtained with the radar sensor.

5. The surveillance apparatus according to claim 1, wherein the optical camera further comprises a translucent camera cover.

6. The surveillance apparatus according to claim 5, wherein the camera cover comprises a substantially hemispheric camera dome having a polygonal, cylindrical or circular outline.

7. The surveillance apparatus according to claim 1, wherein the plurality of elements of the radar sensor are each antenna elements arranged on the periphery of the surveillance apparatus.

8. The surveillance apparatus according to claim 1, wherein the radar sensor is configured to provide at least one of a direction, range and speed of an object relative to the surveillance apparatus.

9. The surveillance apparatus according to claim 5, wherein the camera cover further comprises a translucent antenna.

10. The surveillance apparatus according to claim 9, wherein the translucent antenna comprises an electrically conductive layer comprising at least one of a translucent electrically conductive material and an electrically conductive mesh structure.

11. The surveillance apparatus according to claim 10, wherein a first electrically conductive layer comprises a ground plane and a second electrically conductive layer comprises an antenna element.

12. The surveillance apparatus according to claim 11, wherein the ground plane comprises a slot for feeding the antenna element.

13. The surveillance apparatus according to claim 12, wherein the camera cover comprises at least one dielectric layer made from at least one of glass or a translucent polymer, and two electrically conductive layers.

14. The surveillance apparatus according to claim 1, wherein:

the circuitry is configured to process the captured images of the optical camera and the received electromagnetic radiation of the radar sensor and provide an indication of the detection of the presence of the object.

15. A surveillance radar apparatus for retrofitting an optical surveillance camera, having a first field of view of a first size, comprising:

a housing for arrangement of the surveillance radar apparatus at the surveillance camera;

a radar sensor that emits and receives electromagnetic radiation, the radar sensor having a second field of view of a second size that is greater than the first size, the radar sensor including a plurality of elements each having a third field of view of a size that is substantially similar to the first size and that covers less than an entirety of the second field of view; and circuitry configured to identify that an object has been detected based on electromagnetic radiation received by at least one of the plurality of elements; and control an actuator of the surveillance apparatus to move the optical camera so that an orientation of the first field of view enters the third field of the at least one of the plurality of elements.

16. The surveillance radar apparatus according to claim 15, wherein the housing comprises an alignment member for aligning a position of the surveillance radar apparatus with respect to the surveillance camera.

17. A surveillance method comprising:

capturing images based on received light with an optical camera, the optical camera included within a housing and having a first field of view of a first size;

emitting and receiving electromagnetic radiation with a radar sensor attached to an outer surface of the housing, the radar sensor having a second field of view of a second size that is greater than the first size and including a plurality of elements each having a third field of view of a size that is substantially similar to the first size and that covers less than an entirety of the second field of views;

identifying that an object has been detected based on electromagnetic radiation received by at least one of the plurality of elements; and controlling an actuator to move the optical camera so that an orientation of the first field of view enters the third field of view of the at least one of the plurality of elements.

18. A non-transitory computer-readable recording medium that stores therein a computer program product, which, when executed by a processor, causes the method according to claim 17 to be performed.

19. A surveillance apparatus comprising:

a housing;

an optical camera included in the housing, the optical camera having a first field of view of a first size;

an actuator configured to at least pan and tilt the optical camera within the housing;

a plurality of radar sensor elements attached to an outer surface of the housing, the radar sensor configured to emit and receive electromagnetic radiation, each of the plurality of radar sensor elements having a second field of view of a size that is substantially similar to the first size and that covers less than an entirety of the first field of view; and circuitry configured to identify that an object has been detected based on electromagnetic radiation received by at least one of the plurality of radar sensor elements; and control the actuator to move the optical camera to change an orientation of the first field of view to enter the second field of view of the at least one of the plurality of radar sensor elements.

* * * * *